US008726420B1

(12) United States Patent
Uitermarkt

(10) Patent No.: US 8,726,420 B1
(45) Date of Patent: May 20, 2014

(54) CUSHIONING CAP VISOR

(71) Applicant: Michel Uitermarkt, Rotterdam (NL)

(72) Inventor: Michel Uitermarkt, Rotterdam (NL)

(73) Assignee: Michel Uitermarkt, Rotterdam (NL)

( * ) Notice: Subject to any disclaimer, the term of this patent is extended or adjusted under 35 U.S.C. 154(b) by 0 days.

(21) Appl. No.: 14/057,030

(22) Filed: Oct. 18, 2013

(51) Int. Cl.
*A42B 1/00* (2006.01)
*A42B 1/06* (2006.01)

(52) U.S. Cl.
CPC ..... *A42B 1/063* (2013.01)
USPC ..... 2/195.6; 2/175.5; 2/195.1; 2/209.12

(58) Field of Classification Search
CPC ..... A42B 1/062–1/065
USPC ..... 2/175.1, 175.5, 195.1, 195.6, 209.12, 2/171, 181, 175.4, 195.5, 10, 410; D2/872–873, 886, 893, 891, 882
See application file for complete search history.

(56) References Cited

U.S. PATENT DOCUMENTS 1,506,815 A * 9/1924 Cormay ..... 2/10
1,569,658 A * 1/1926 Levinson ..... 2/10
2,158,861 A * 5/1939 Meyer ..... 2/195.1
3,047,880 A * 8/1962 Lev ..... 2/195.6
4,292,689 A * 10/1981 Townsend, Jr. ..... 2/12
4,793,006 A * 12/1988 Dawson ..... 2/195.1
4,945,575 A * 8/1990 Townsend ..... 2/12
5,075,898 A * 12/1991 Bedient ..... 2/10
5,105,476 A * 4/1992 Cox ..... 2/12
5,197,150 A * 3/1993 Bedient ..... 2/10
5,621,915 A * 4/1997 Schneider et al. ..... 2/10
5,781,933 A * 7/1998 De Giacomi ..... 2/195.1
6,138,279 A * 10/2000 Gore ..... 2/175.5
6,202,218 B1 * 3/2001 Chen ..... 2/195.1
6,311,331 B1 * 11/2001 Park ..... 2/195.1
6,408,443 B1 6/2002 Park
6,990,695 B2 * 1/2006 Grayson ..... 4/613
D552,332 S * 10/2007 Saveliev ..... D2/893
7,278,173 B2 10/2007 Turner
D556,429 S * 12/2007 Saveliev ..... D2/893
D557,881 S * 12/2007 Saveliev ..... D2/893
D617,981 S * 6/2010 Hines et al. ..... D2/893
2003/0106135 A1 6/2003 Landers
2003/0226193 A1 * 12/2003 Wang ..... 2/195.6
2004/0006807 A1 1/2004 Wang
2004/0231033 A1 * 11/2004 Cho ..... 2/195.1
2005/0235395 A1 10/2005 Tseng
2006/0174397 A1 8/2006 Taguchi
2010/0011485 A1 * 1/2010 Cho ..... 2/195.6
2012/0066814 A1 * 3/2012 Adams et al. ..... 2/195.1
2013/0047317 A1 * 2/2013 Hanover et al. ..... 2/209.12

* cited by examiner

*Primary Examiner* — Amber Anderson
*Assistant Examiner* — Brieanna Fuller

(57) ABSTRACT

A visor configuration for inside the brim of a baseball cap, that solves the problem of discomfort due to pressure against a baseball cap wearer's forehead, by providing a mechanism that enables a single, continuous piece of visor material with a T-shaped cut out space in the visor's middle section and two arched shaped cut out spaces in the visor's sides to have a cushioning effect as a result of newly allowed motion.

4 Claims, 6 Drawing Sheets

FIG.2.B. (prior art)

FIG.4.A.
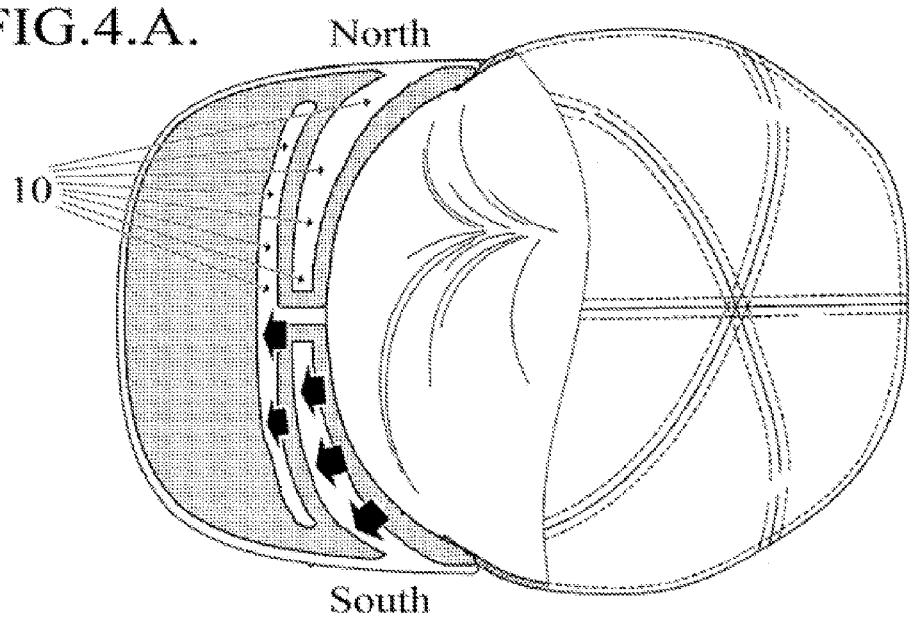
FIG.4.B.
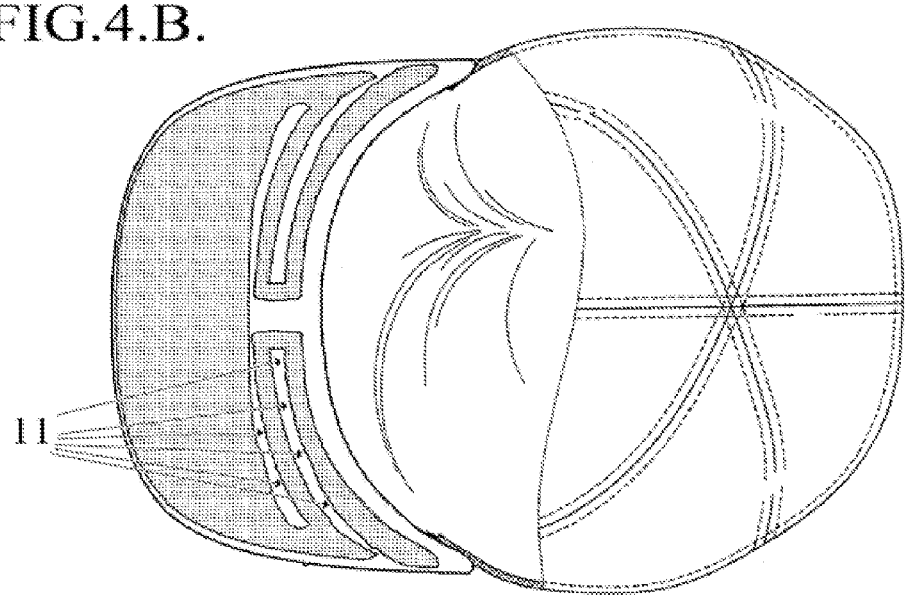

CUSHIONING CAP VISOR

CROSS-REFERENCE TO RELATED APPLICATION

Not applicable

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISC APPENDIX

Not applicable

BACKGROUND OF THE INVENTION

A significant number of people wear headwear with an attached brim, perhaps a baseball cap being the most common or popular of such items. The invention described in this document pertains to the field of brimmed headwear in general, and to baseball caps in particular.

The baseball cap consists of a crown portion to accommodate at least part of the wearer's head and an attached brim portion. The brim commonly consists of top and bottom pieces of fabric with a visor typically sandwiched in between the pieces. As such, the visor is generally (semi-) rigid and serves as the core layer of the brim. Visors can consist of a single piece or of multiple pieces. Visors can consist of one material or a variety of materials. Often a plastic or cardboard material with a thickness not much greater than 3 millimeters is used.

The functions of a brim vary from protecting the wearer's eyes and face from weather elements such as sun and rain, to enhancing the headgear's appearance for aesthetic purposes. A great many alterations have been made to the visor with these purposes in mind. Of note, Boo Yl Park, U.S. Pat. No. 6,408,443, proposes to have the inner & outer portions of the visor to be partially cut at predetermined intervals, primarily so as to allow the visor of a reversible headwear piece to maintain a desired curved shape when bent along the cut lines. Also, part of the patent application by Tai-Kuang Wang, US patent application 20040006807, suggests making cuts or cut-out holes to both the visor as well as the crown portion of the headwear for aesthetic and air ventilation purposes.

While a certain level of visor stiffness is indeed necessary to properly perform the functions mentioned at the top of the prior paragraph, using a (semi-) rigid material in the brim has a major negative drawback: pressure is exerted to the wearer's head in the areas where the visor is attached to the headwear's crown portion, typically the forehead area with baseball caps, creating significant discomfort.

Attempts have been made to address this discomfort. Luke Evan Landers, US patent application 20030106135, has proposed to use a much softer overall material for the entire visor. Nevertheless, this severely diminishes a brim's much coveted capability to retain a desired shape. In an attempt to properly accommodate the varying shapes and sizes of the headwear's crown portion David Turner, U.S. Pat. No. 7,278,173, elected to insert slits into the visor, subdividing the visor into portions, so that the brim could expand in width if needed as a result of a stretching of the crown portion of the headwear. However, additional comfort is only achieved to the extent that such portions can move relative to one another. The portions in and of themselves do not provide any cushioning solution to direct pressure. An alternative approach has been to use a visor consisting of multiple pieces and multiple materials. The filing of Hui Tseng, in US patent application 20050235395, and the filing of Jon Kazuo Taguchi, in US patent application 20060174397, both describe visor embodiments that use this approach. Such embodiments typically include deformable and non-deformable portions, where the softer, more forgiving portion is positioned at the rear-end of the visor, i.e. where the visor is attached to the headwear's crown and thus most impacts the wearer's forehead area. Using multiple pieces and/or more than one material though, inevitably brings about a more complicated, more costly manufacturing process.

Alas, no prior art provides an optimal solution that combines great functionality with cost efficiency.

BRIEF SUMMARY OF THE INVENTION

A visor configuration embodying the principles of my invention that solves the problem of discomfort from pressure against a headgear (e.g. a baseball cap) wearer's forehead, by providing a mechanism that enables a single, continuous piece of visor material to have a cushioning effect.

By strategically omitting or removing parts of the visor material (which would otherwise conventionally occupy the full aerial extent of the brim), such omitted or removable parts being cut outs specifically being a T-shaped cut out space in the visor's substantial middle section and one arched shaped cut out space on each of its sides, sufficient space is created to permit parts of the rear end of the visor to move in a direction away from the wearer's forehead. This newly allowed motion dampens the impact and mitigates strain for the wearer.

Furthermore, considering that the vast majority of baseball caps have visors that consist of one material, the present innovation is well-suited for application in a fairly conventional manufacturing process, allowing for a better end product in an efficient and cost effective manner.

BRIEF DESCRIPTION OF THE SEVERAL VIEWS OF THE INVENTION

FIG. 1. is a side view of a person wearing a baseball cap with a common brim configuration based on prior art, in which the lightning bolt symbols illustrate the approximate areas where a brim that does not embody a visor with the principles of my invention can exert pressure to the head of the wearer. Pressure areas are indicated by (1), the common brim by (2), crown (3).

FIG. 2.A. is a perspective view of a visor (4) and the fabric part (5) of a baseball cap's brim, illustrating how a visor can insert into the fabric part, as such combining to form the brim.

FIG. 2.B. is a top plan view of a visor (4) as it is common in prior art, not based on the present invention.

FIG. 2.C. is a top plan view of the fabric part (5) of a baseball cap's brim.

FIG. 3. is a top plan view of one embodiment of a visor configuration (6) that incorporates the principles of the present invention. A T-shaped cut out space located within a substantial middle portion of the visor is illustrated by (7). Two arched shaped cut out spaces, one on the left side indicated by (8) and one on the right side by (9), each respectively extending into an interior of the visor. As shown, the visor configuration (6) as a whole has two arched shaped cut out spaces.

FIG. 4.A. is a top plan view of a baseball cap with a visor that embodies the principles of my invention.

FIG. 4.B. is a top plan view of a baseball cap with a visor that embodies the principles of my invention, in which the visor illustrates how the cushioning effect actually works.

FIG. 5. is a similar top plan view as FIG. 3. FIG. 5 is intended to elaborate on which parts of one embodiment of a visor configuration (6) that incorporates the principles of the present invention that are considered to be the front half (14), back half (15), the front edge (12) and the back edge (13).

FIG. 6. is a similar top plan view as FIG. 3. FIG. 6 is intended to elaborate on which parts of one embodiment of a visor configuration (6) that incorporates the principles of the present invention that are considered to be the left edge (16), the right edge (17), the left half (18) of the back edge and the right half (19) of the back edge.

DETAILED DESCRIPTION OF THE INVENTION

NOTE: The figures mentioned in this document serve as illustrative examples. The shapes and proportions of actual visors embodying the principles of my invention may, within the boundaries set forth by the CLAIMS section of this document, vary.

FIG. 1. Shows headwear, a baseball cap, as regularly worn which is constructed with the back-end of the brim attached to the lower-end, front portion of the crown (3). A common brim (2) based on prior art here is defined as one with a (semi-) rigid visor that does not embody the principles of my invention. From FIG. 1. it is clear that for a wearer wishing to accomplish a proper fit, the (semi-) rigid nature of the visor inside the brim can put pressure on the wearer's forehead via area (1). In FIG. 1. such pressure is indicated by the lightning bolt symbols (1).

The parts that make a conventional brim, consisting of top and bottom pieces of fabric with a (semi-) rigid material visor piece typically sandwiched in between the fabric pieces, are shown in FIG. 2.A. FIG. 2.A. also illustrates how the visor part (4) is inserted into the fabric part (5), so as to form a conventional brim. FIG. 2.B. illustrates a conventional visor piece (4) based on prior art, which does not embody the principles of my invention. FIG. 2.C. illustrates the fabric part (5). The conventional visor piece (4) is of an almost equal, albeit slightly smaller, size as the fabric part (5) and thus generally approximates a surface area almost equal to the surface area of the fabric part.

FIG. 3. shows one embodiment of the visor configuration (6) which is based on the principles of my invention. The material of the visor does not have a thickness greater than 2 millimeters. The visor consists of a single, continuous piece of material. Cut out spaces indicated by (7, 8, & 9) serve as examples of the space that is created by strategically removing, or omitting, pieces of material from the visor's back half (15), most specifically in parallel to, and potentially also part of, the visor's back edge. Here, (7) illustrates a T-shaped cut out space located within a substantial middle portion of the visor. The stem portion of said T-shaped cut out space extends into an interior middle portion of the visor and the stem portion separates a left side and a right side of the visor's back edge (13). The head portion of said T-shaped cut out space extends outwardly from the stem portion towards left and right side edges (16, 17) of the visor. Reference number (8) indicates an arched shaped cut out space in the back half (15) of the visor that extends from the visor's left side edge (16) into an interior of said visor. Reference number (9) indicates a similar arched shaped cut out space, but extending from the visor's right side edge (17). Both (8) and (9) run substantially parallel with the visor's back edge (13) towards the interior middle portion of said visor. The remaining sections of the back half (15) of the visor in combination with the T-shaped cut out space (7) and the two arched shaped cut out spaces (8,9) allow said back half (15) of the visor to flexibly move in a direction away from the wearer's head, thus creating the cushioning mechanism.

The figures on sheet 4, FIG. 4.A. and FIG. 4.B., demonstrate how the visor configuration (6) that is based on the principles of my invention, actually works as part of the brim of a baseball cap to solve the problem of discomfort caused by pressure against a wearer's forehead. The dotted areas inside the brims of both FIG. 4.A. and FIG. 4.B. serve as illustrative examples of the new visor configurations, based on the principles of my invention. In FIG. 4.A. on the north side of the visor, the long narrow arrows indicated by (10) clearly point out the space that is created by a T-shaped cut out in the visor's substantial middle portion as well as the space that is created by the arched shaped cut out extending from the right side edge into the interior of the visor strategically removing, or omitting, pieces of material from the visor's back half, most specifically in parallel to, and in this case also part of, the visor's back edge. The short fat arrows on the south side of the visor in FIG. 4.A. illustrate how, due to the principles of my invention, pieces of the visor's back half are now able to flexibly move in motions away from the wearer's forehead, thus enabling a cushioning effect that significantly alleviates pressure from the visor on the forehead. FIG. 4.B. has an identical visor configuration as described in FIG. 4.A., yet in FIG. 4.B. the cushioning effect is now illustrated at work. FIG. 4.B. shows how the pieces of in the visor's back half are now in a different position from the earlier shown FIG. 4.A. In fact, in FIG. 4.B. pieces of the visor's back half have moved further away from the wearer's forehead, using the space earlier pointed out by (10) in FIG. 4.A as a means to alleviate pressure. Comparing the space indicated by the long narrow arrows of (10) in FIG. 4.A. with the space indicated by the long narrow arrows of (11) in FIG. 4.B., clearly demonstrates the realization of this cushioning due to the principles of my invention.

Figure 1:
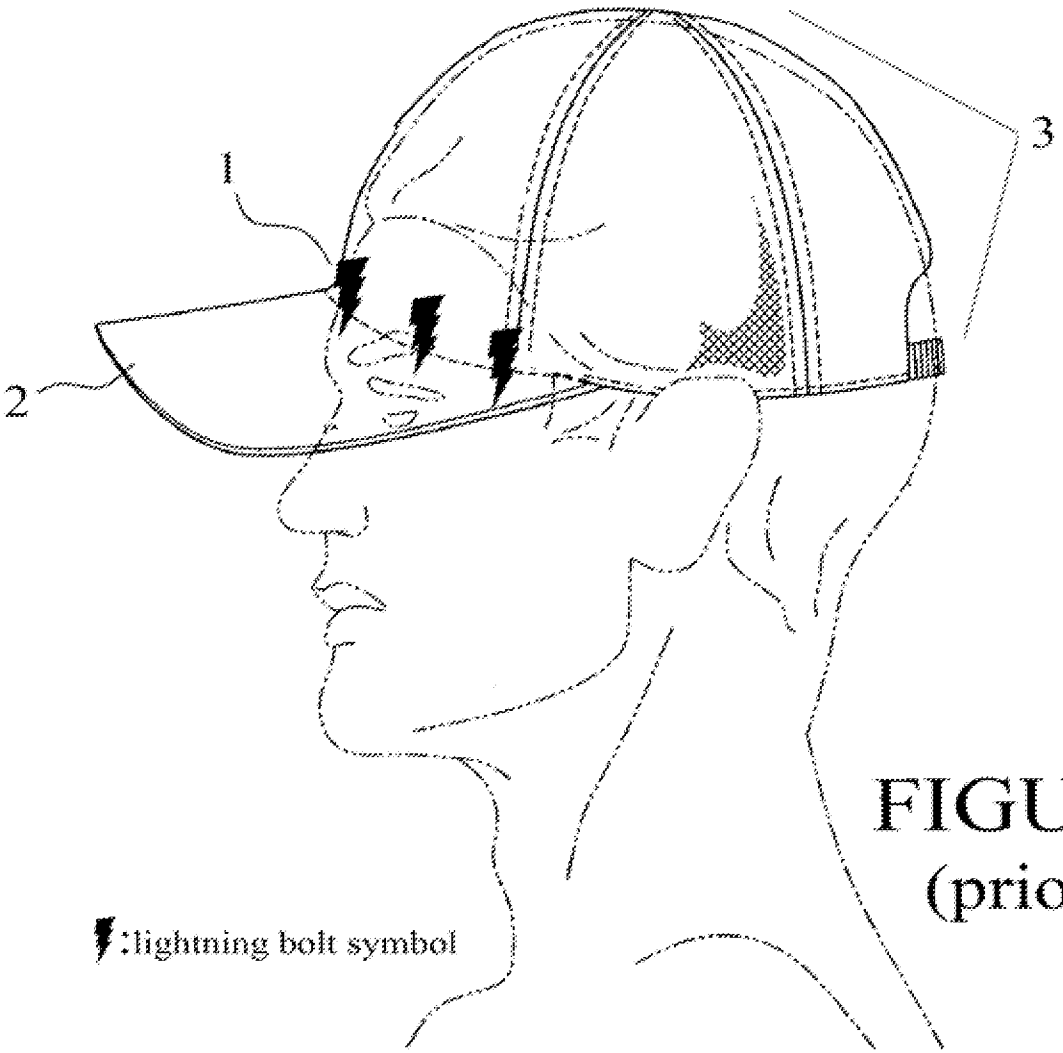
FIGURE 1 (prior art)
Figure 2:
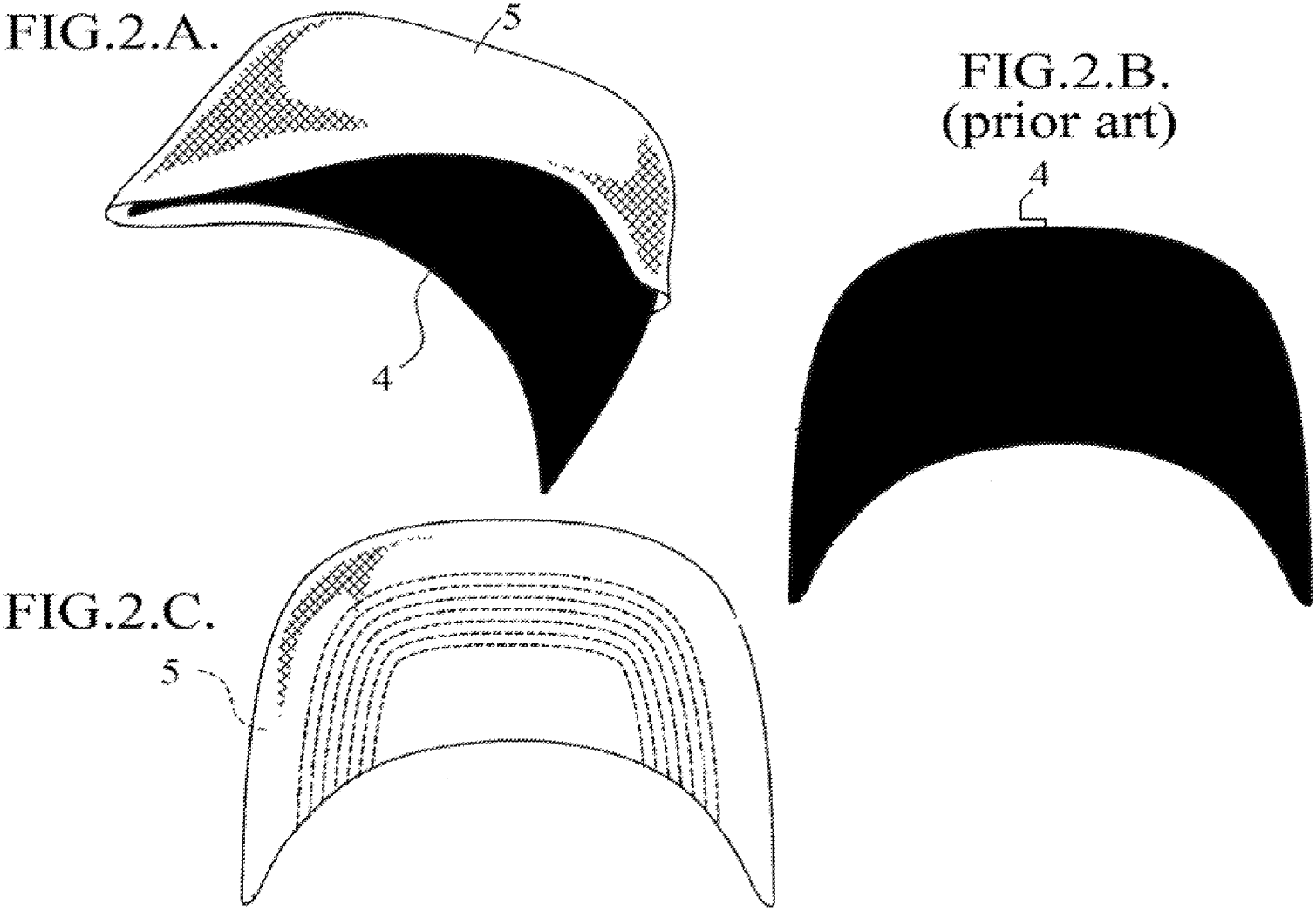
Figure 3:
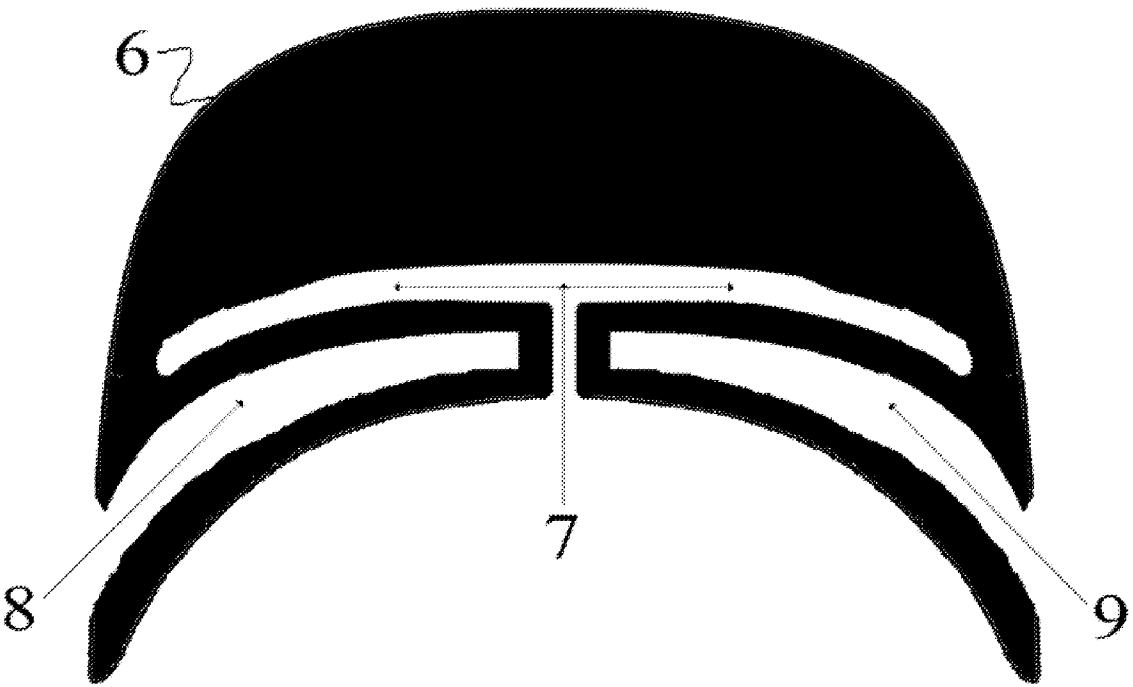
Figure 5:
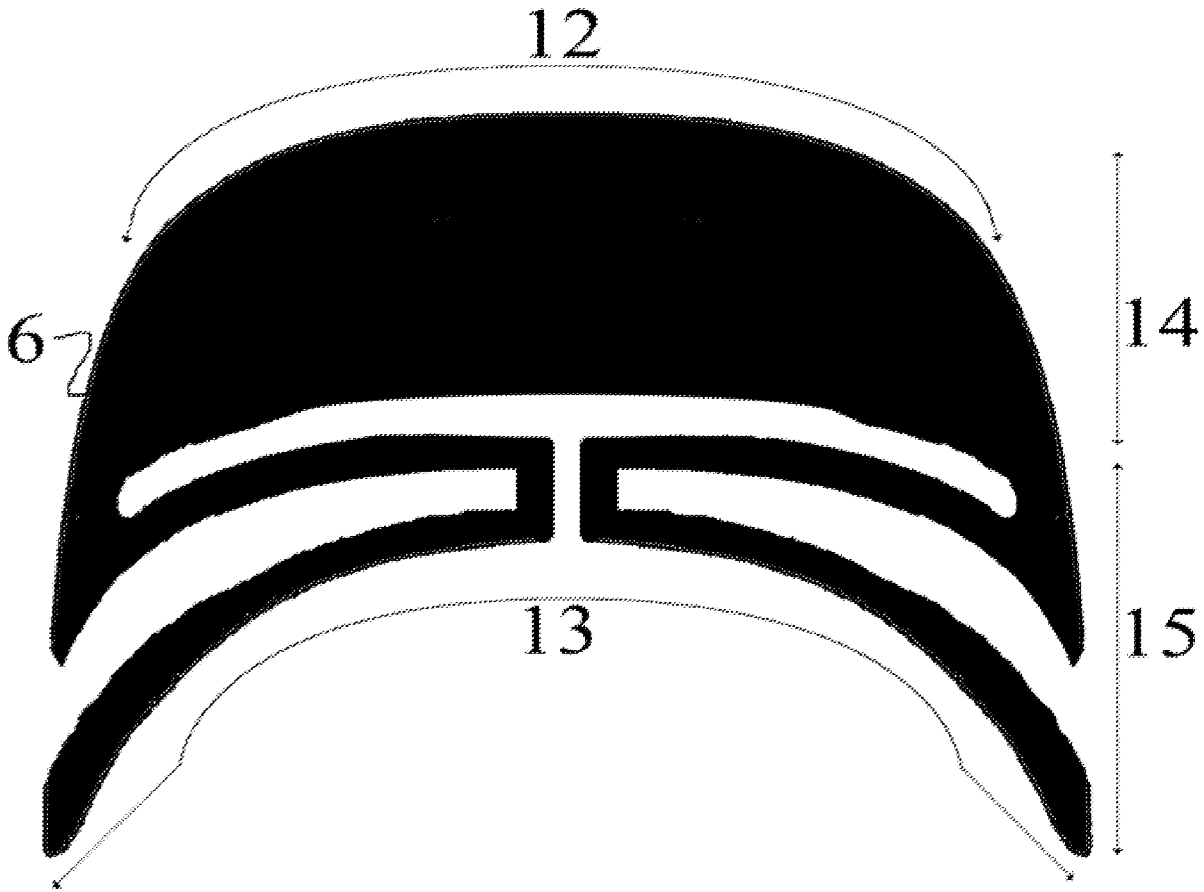
FIG. 5 is intended to elaborate on which parts of one embodiment of the visor configuration (6) that incorporates the principles of the present invention are considered to be the front half (14), back half (15), the front edge (12) and the back edge (13). The visor configuration of FIG. 5 is exactly similar to the visor configuration of FIG. 3.
Figure 6:
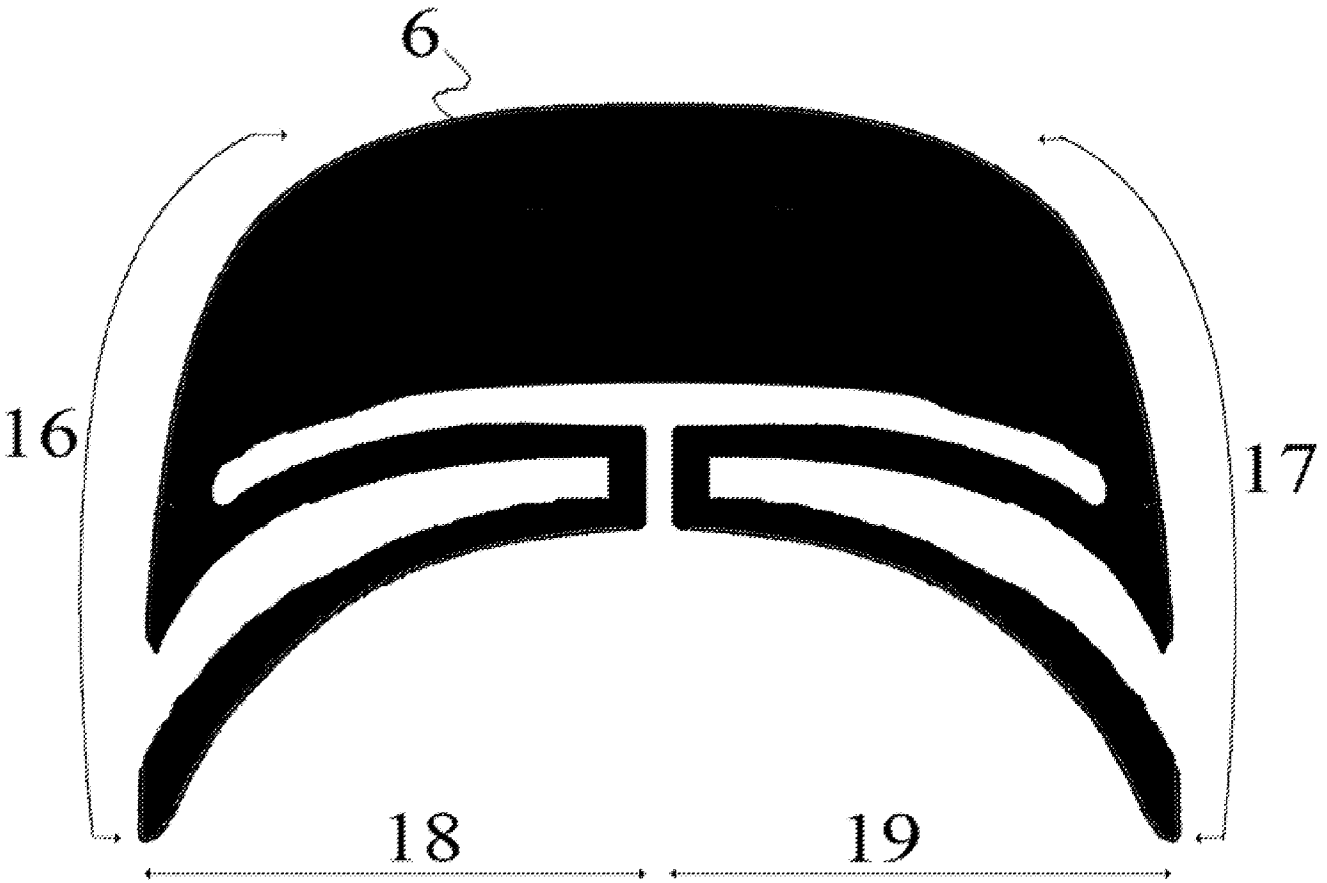
FIG. 6 is intended to elaborate on which parts of one embodiment of the visor configuration (6) that incorporates the principles of the present invention are considered to be the left edge (16), the right edge (17), left half (18) of the back edge (13) and the right half (19) of the back edge (13). The visor configuration of FIG. 6 is exactly similar to the visor configuration of FIG. 3.

A visor configuration for inside the brim of an item of headwear, such as a baseball cap, that solves the problem of discomfort from pressure against a baseball cap wearer's forehead. The visor configuration enables a single, continuous piece of visor material with a T-shaped cut out space in the visor's middle section and two arched shaped cut out spaces in the visor's sides to provide a cushioning effect as a result of the visor's back half moving in a motion away from the wearer's head through the technique of omitting or removing parts of the visor material via the noted cut out spaces in order to facilitate cushioning an impact.

What is claimed is:

1. A visor configuration inserted within a brim of a baseball cap that provides a cushioning mechanism to the wearer's head due to pressure being exerted to the baseball cap wearer's head, the visor configuration comprising:

a visor consisting of a single, continuous piece of material that has a back half and front half;

each of said back half and front half comprises a left side and a right side together forming left and right side edges of said visor, the left and right side edges of said visor running perpendicularly to a front and back edge of said visor;

a T-shaped cut out space located within a substantial middle portion of said visor with a stem portion of said T-shaped cut out space extending into an interior middle portion of said visor and separating said back edge into a left and right side of said back edge of said visor;

a head portion of said T-shaped cut out space extending outwardly from said stem portion towards said left and right side edges of said visor;

two arched shaped cut out spaces extending into an interior of said visor, one each from said left and right side edges, respectively, of said back half of said visor substantially parallel to said back edge of said visor towards said interior middle portion of said visor;

remaining sections of said back half of said visor in combination with said T-shaped cut out space and said two arched shaped cut out spaces allow said back half of said visor to flexibly move in a direction away from the wearer's head creating the cushioning mechanism; and wherein said visor is defined as a layer of material placed in between a top fabric piece and a bottom fabric piece of the brim of the baseball cap.

2. The visor configuration of claim 1, wherein said layer of material is plastic.

3. The visor configuration of claim 1, wherein said layer of material is cardboard.

4. The visor configuration of claim 1, wherein said layer of material does not have a thickness greater than two millimeters.

* * * * *